US005838283A

United States Patent [19]

Nakano

[11] Patent Number: 5,838,283

[45] Date of Patent: Nov. 17, 1998

[54] LOOP ANTENNA FOR RADIATING CIRCULARLY POLARIZED WAVES

[75] Inventor: Hisamatsu Nakano, Tokyo, Japan

[73] Assignee: Nippon Antenna Kabushiki Kaishya, Tokyo, Japan

[21] Appl. No.: 704,696

[22] PCT Filed: Jan. 18, 1996

[86] PCT No.: PCT/JP96/00071

§ 371 Date: Sep. 17, 1996

§ 102(e) Date: Sep. 17, 1996

[87] PCT Pub. No.: WO96/22618

PCT Pub. Date: Jul. 25, 1996

[30] Foreign Application Priority Data

Jan. 18, 1995 [JP] Japan ..... 7-022362

[51] Int. Cl.[6] ..... H01Q 11/12

[52] U.S. Cl. ..... 343/741; 343/866; 343/742

[58] Field of Search ..... 343/741, 742, 343/866, 867; H01Q 11/12

[56] References Cited

U.S. PATENT DOCUMENTS

| | | | |
|---|---|---|---|
| 2,116,734 | 5/1938 | Reinartz | 343/741 |
| 2,405,123 | 8/1946 | Fyler | 343/867 |
| 2,785,396 | 3/1957 | Carter | 343/741 |
| 3,833,908 | 9/1974 | Loh | 343/741 |
| 5,371,509 | 12/1994 | Wallace, Jr. et al. | 343/741 |

FOREIGN PATENT DOCUMENTS

| | | |
|---|---|---|
| 2-214304 | 8/1990 | Japan . |
| 4-80114 | 7/1992 | Japan . |
| 7-249921 | 9/1995 | Japan . |

*Primary Examiner*—Hoanganh Le

*Attorney, Agent, or Firm*—Pollock, Vande, Sande & Priddy

[57] ABSTRACT

A loop antenna for a circularly polarized wave can operate in a wide frequency range and can be simply constructed. A radiating power fed to a feeding point via a coaxial line and a feeder conductor is transmitted through an I-shape conductor to a C-type loop element disposed in spaced facing relation to a ground plane. By the action of a cutoff part formed on the C-type loop element, the C-type loop element radiates a circularly polarized wave. An angle of between 35° and 45° formed by the I-shape conductor and the cutoff part.

8 Claims, 6 Drawing Sheets

CI-TYPE

C2-TYPE

LOOP ANTENNA FOR RADIATING CIRCULARLY POLARIZED WAVES

TECHNICAL FIELD

The present invention relates generally to a loop antenna for radiating a circularly polarized wave, particularly to a loop antenna that is suitable for use in a terminal device for a communication system of a circularly polarized wave mode.

BACKGROUND ART

A loop antenna for circularly polarized waves having a thin and low construction is suitable as an antenna for being mounted on mobile facilities such as automobiles and aircraft, since projections made by the antenna being mounted cannot apparently be seen. There have been various proposals for such a circularly polarized antenna. One example is a "loop antenna having passive element, B-104" which was announced by Mr. Hisamatsu Nakano and three others, in the spring national conference of the Japan Electronic Information Communication Institute of 1994 and recorded in page 2–104. The abovementioned loop antenna for radiating a circularly polarized wave is shown in FIG. 5 through FIG. 7. FIG. 6 illustrates a C1-type loop antenna for circularly polarized wave as a first example, and FIG. 7 illustrates a C2-type loop antenna for circularly polarized wave as a second example.

FIG. 5 is a front elevation view of the circularly polarized wave antenna, and FIG. 6 is a top view of the C1-type loop antenna for circularly polarized wave.

The C1-type loop antenna for radiating a circularly polarized wave has a coaxial feeder loop element 100 placed in parallel to a ground plane 105, and a passive loop element 101 having a larger diameter than the coaxial feeder loop element 100 is placed above and in parallel to the coaxial feeder loop element 100 maintaining a concentric configuration thereto. The space between the ground plane 105 and the coaxial feeder loop element 100 is specified as $H_1$, and the space between the ground plane 105 and the passive element 101 is specified as Hp.

In the circularly polarized loop antenna thus constructed, the coaxial feeder loop element 100 is fed such that one end of an I-shape conductor 104 is, as shown in FIG. 6, connected to the coaxial feeder loop element 100 and the other end of the I-shape conductor is connected to a feeder conductor 106. The feeder conductor 106 is connected to a central conductor of a coaxial line 102, as shown in FIG. 5.

The passive loop element 101 is provided with a cutoff part 103; an angle formed by the cutoff part 103 and the I-shape conductor 104, and a length of the cutoff part 103 are specified as Φp, and Δg, respectively.

In this case, provided that the angle Φp is specified to be close to +45° or −135°, a left-handed circularly polarized wave will be radiated by the action of the cutoff part 103; provided that the angle Φp is specified to be close to −45° or +135° a right-handed circularly polarized wave will be radiated by the action of the cutoff part 103. Thereat, a current of a virtually progressive wave flows in the coaxial feeder loop element 100 and the passive loop element 101. When the circumferential length of the coaxial feeder loop element 100, C1=1λ, the circumferential length of the passive loop element 101, C2=1.25λ, $H_1$=0.0667λ, Hp=0.0792λ, Δg=0.0104λ, Φp=±42° or 139° are given, wherein λ is the natural space wavelength, the gain vs. frequency characteristics of the C1-type loop antenna for circularly polarized wave is shown as b in FIG. 3, and the circularly polarized wave axial ratio vs. frequency characteristics is shown as b in FIG. 4.

FIG. 7 is a top view of the C2-type loop antenna for radiating a circularly polarized wave. The C2-type loop antenna for circularly polarized wave has the coaxial feeder loop element 100 placed in parallel to the ground plane 105, and the passive loop element 101 having a larger diameter than the coaxial feeder loop element 100 is placed above and in parallel to the coaxial feeder loop element 100 maintaining a concentric configuration thereto. The space between the ground plane 105 and the coaxial feeder loop element 100 is specified as $H_1$, and the space between the ground plane 105 and the passive element 101 is specified as Hp.

In the C2-type circularly polarized loop antenna thus constructed, the coaxial feeder loop element 100 is fed such that one end of the I-shape conductor 104 is, as shown in FIG. 7, connected to the coaxial feeder loop element 100 and the other end of the I-shape conductor is connected to the feeder conductor 106. The feeder conductor 106 is connected to the central conductor of the coaxial line 102, as shown in FIG. 5.

The passive loop element 101 is provided with two cutoff parts 103 located opposite to each other; an angle formed by the cutoff part 103 and the axis of the I-shape conductor 104, and the length of the cutoff part 103 are specified as Φp, and Δg, respectively.

In this case, provided that the angle Φp is specified to be close to +45° and −135°, a left-handed circularly polarized wave will be radiated by the action of the cutoff parts 103; provided that the angle Φp is specified to be close to −45° and +135°, a right-handed circularly polarized wave will be radiated by the action of the cutoff parts 103. Thereat, a current of a virtually progressive wave flows in the coaxial feeder loop element 100 and a standing wave current flows in the passive loop element 101.

When the circumferential length of the coaxial feeder loop element 100, C1=1λ, the circumferential length of the passive loop element 101, C2=1.25λ, $H_1$=0.0667λ, Hp=0.1λ, Δg=0.01042λ, $\Phi_p$=+23°, −113° or −23°, +113° are given, wherein λ is the natural space wavelength, the gain vs. frequency characteristics is shown as c in FIG. 3, and the circularly polarized wave axial ratio vs. frequency characteristics is shown as c in FIG. 4.

However, in the conventional loop antenna for circularly polarized wave as shown in FIG. 3 and FIG. 4, the frequency bandwidth wherein a specific gain is produced is narrow and the frequency bandwidth wherein the circularly polarized wave axial ratio of 3.0 dB or less is given is so narrow as about 1.2%, which is a problem.

Further, the conventional antenna needs two loop elements i.e. the coaxial feeder loop and the passive loop, which makes the construction complicated, giving another problem.

It is therefore an object of the present invention to provide a loop antenna for radiating a circularly polarized wave that can widen the frequency bandwidth wherein a specific gain and a specific circularly polarized wave axial ratio vs. frequency characteristics are attained, and it is a further object to provide a simply constructed loop antenna for a circularly polarized wave.

DISCLOSURE OF THE INVENTION

With the foregoing object in view, the loop antenna for a circularly polarized wave according to the present invention comprises a C-type loop element having a cutoff part and an I-shape conductor of which one end is connected to the C-type loop element and the other end is served as a feeding point, and which extends in the radial direction of the C-type loop element, wherein the C-type loop element is placed face to face with a ground plane with a specific space there between.

In the foregoing loop antenna for circularly polarized wave, the angle formed by the cutoff part provided on the C-type loop element and the I-shape conductor is specified to be about ±35° ~±45° or about ±135° ~±145°; the circumferential length of the C-type loop element is specified to be about 1.0λ~1.5λ, the space between the C-type loop element and the ground plane to be about 0.05λ~0.26λ, and the length of the I-shape conductor to be about 0λ~0.47λ, wherein the natural space wavelength is given as λ. According to the present invention, since a loop antenna for a circularly polarized wave can be made by only one loop element, the construction is simpler and the circularly polarized loop antenna can also be made in a small and low construction; and therefore, it will be suitable for a BS or GPS antenna mounted on mobile facilities.

Since the loop antenna for a circularly polarized wave can be fed through a coaxial feeder, the feeder loss can be reduced, making the loop antenna hard to be influenced by conditions surrounding the feeder.

Further, since the loop antenna for a circularly polarized wave according to the present invention has a broad frequency characteristics against the circularly polarized wave axial ratio and a broad gain vs. frequency characteristics having a high gain, it can be used as a shared antenna in a communication system which transmits a plurality of circularly polarized wave modes with different frequencies. Since it has a broad antenna input impedance vs. frequency characteristics, the production process can be simpler, thereby reducing the production cost.

BEST MODE FOR CARRYING OUT THE INVENTION

Figure 1:
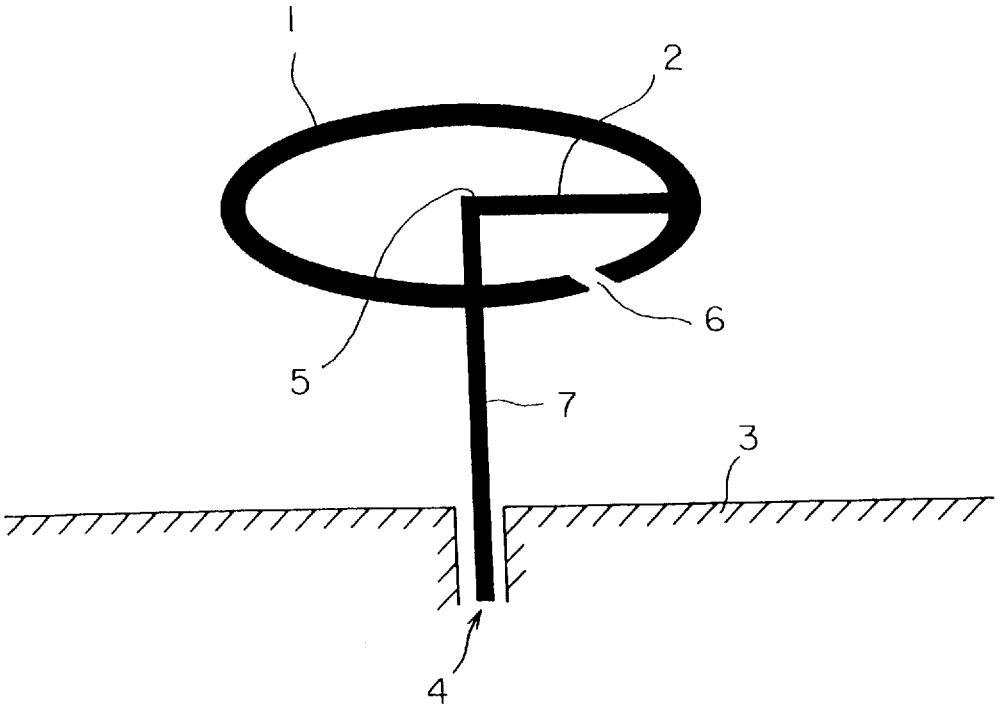
FIG. 1 is a perspective view showing a construction of one embodiment of the loop antenna for a circularly polarized wave according to the present invention.

FIG. 1 is a perspective view showing a construction of one embodiment of the loop antenna for a circularly polarized wave according to the present invention. In this figure, 1 is a C-type loop element formed with a cutoff part 6, 2 is an I-shape conductor of which one end is connected to the C-type loop element 1 and the other end is served as a feeding point 5, 3 is a ground plane in parallel to the C-type loop element 1, 4 is a coaxial line for feeding power to the C-type loop element, and 7 is a feeder conductor of which one end is connected to the feeding point 5 and the other end is connected to a central conductor of the coaxial line 4.

Figure 2:
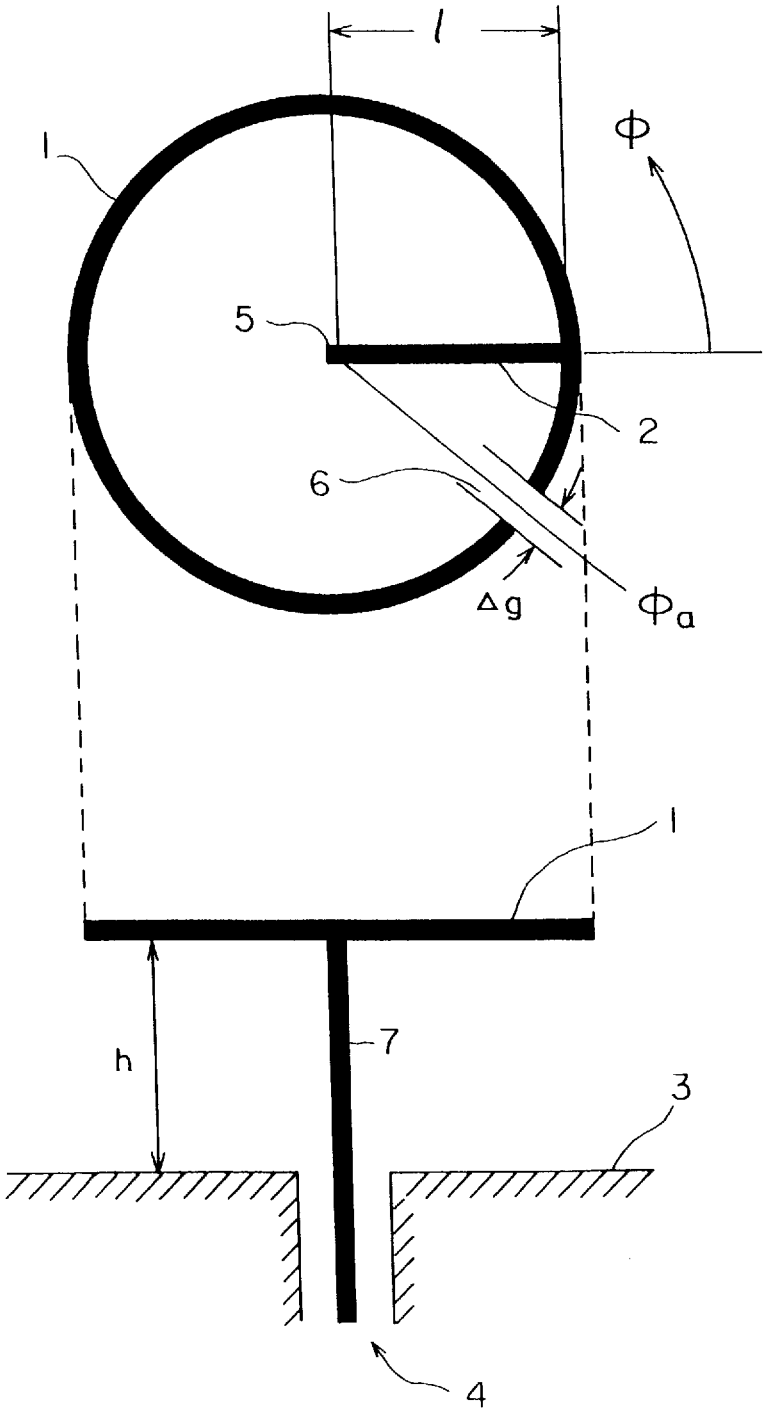
FIG. 2 is a front elevation and top view showing a construction of one embodiment of the loop antenna for a circularly polarized wave according to the present invention.

The top view of the loop antenna for a circularly polarized wave is shown in FIG. 2 (*a*), and the front elevation view is shown in FIG. 2 (*b*).

As shown in FIG. 2, the front end of the feeder conductor 7 is connected to the feeding point 5 at the other end of the I-shape conductor 2, whereby the C-type loop element 1 is fed through the coaxial line 4. The other end of the feeder conductor 7 is connected to the central conductor of the coaxial line 4.

When the C-type loop element 1 is thus fed, it radiates a circularly polarized wave by the action of the cutoff part 6.

The space between the ground plane 3 and the C-type loop element 1 is herein specified as h, the angle formed by the axis of the I-shape conductor 2 and the cutoff part 6 is $\Phi_a$, the length of the cutoff part 6 is Δg, the length of the I-shape conductor is l, and the circumferential length of the C-type loop element 1 as c, although not illustrated.

Figure 3:
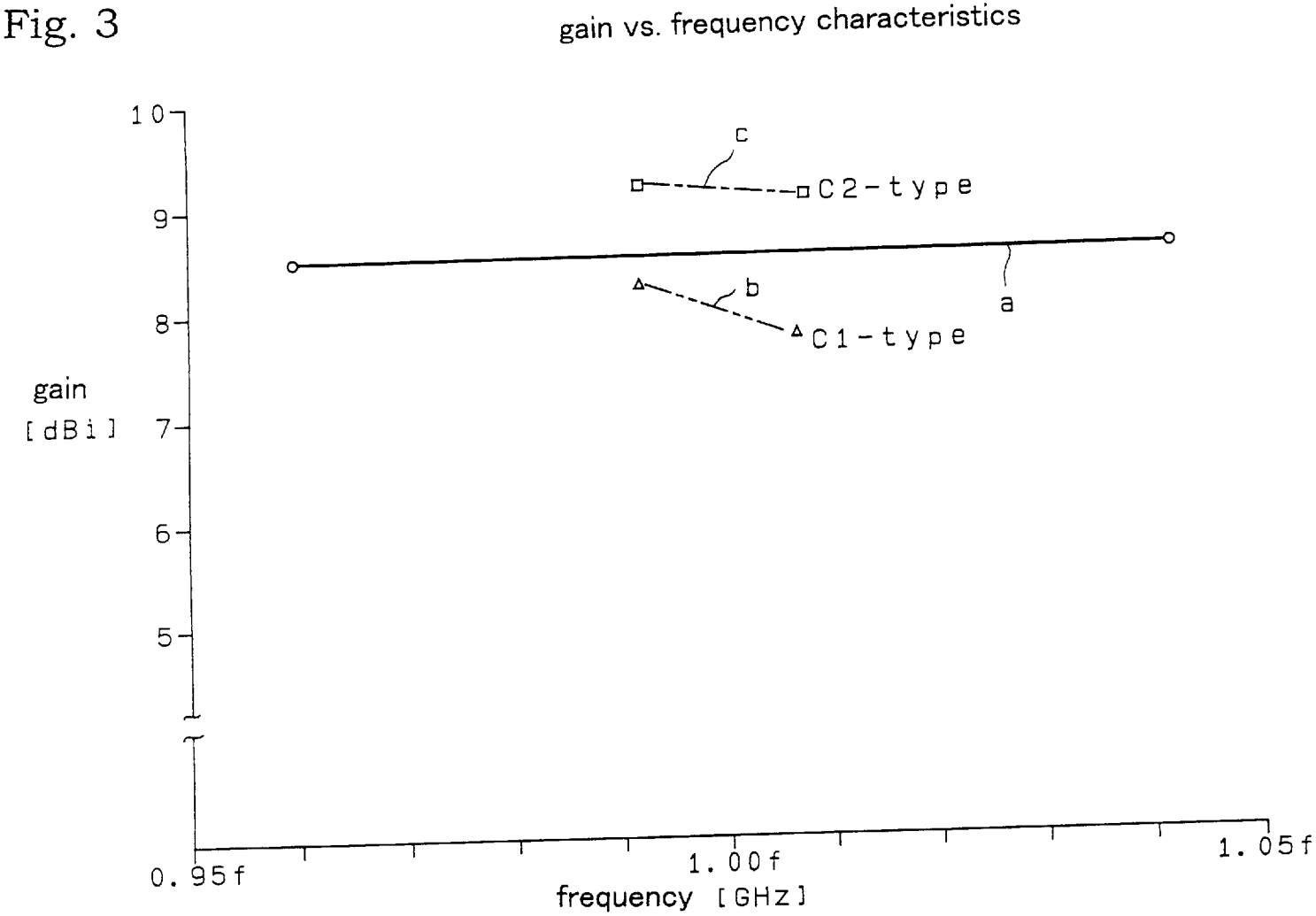
FIG. 3 is a chart showing a gain vs. frequency characteristics of the loop antenna for a circularly polarized wave according to the present invention and the conventional construction.
Figure 4:
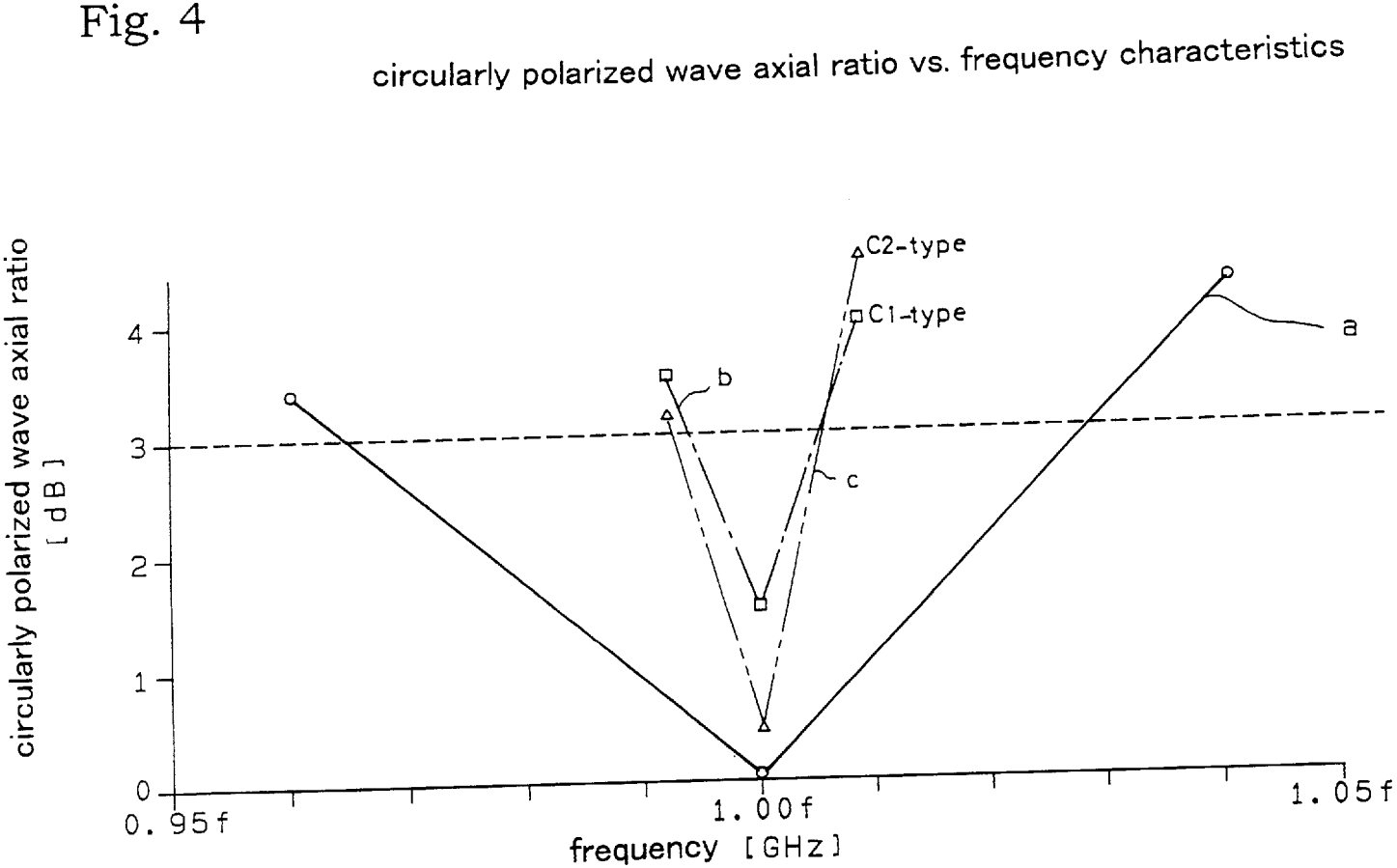
FIG. 4 is a chart showing a circularly polarized wave axial ratio vs. frequency characteristics of the loop antenna for a circularly polarized wave according to the present invention and the conventional construction.
Figure 5:
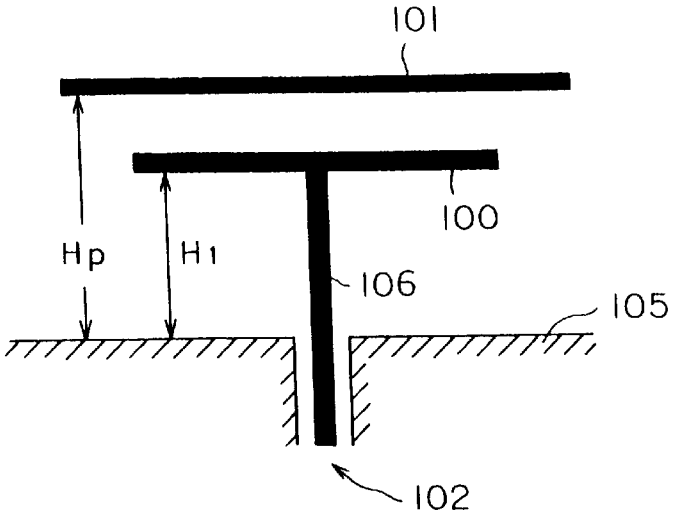
Fig. 5 PRIOR ART
FIG. 5 is a front elevation view showing one example of a construction of the conventional loop antenna for a circularly polarized wave.
Figure 6:
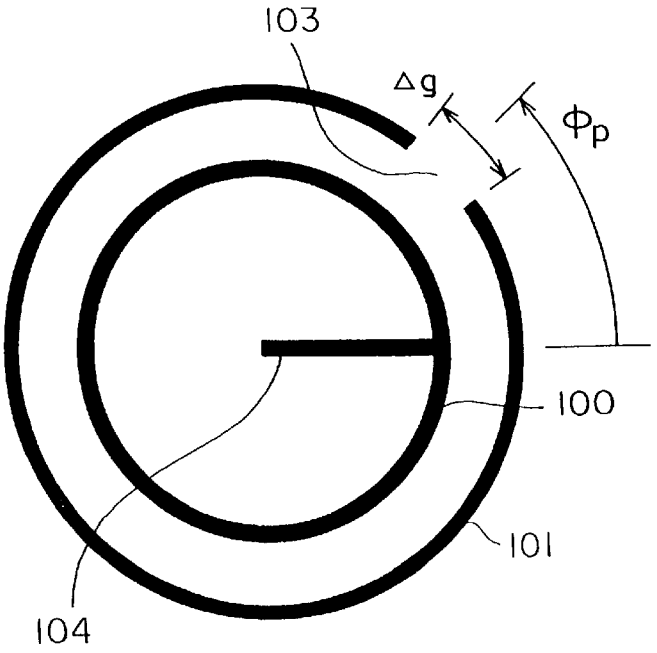
Fig. 6 PRIOR ART
FIG. 6 is a top view showing one example of a construction of the conventional loop antenna for a circularly polarized wave.
Figure 7:
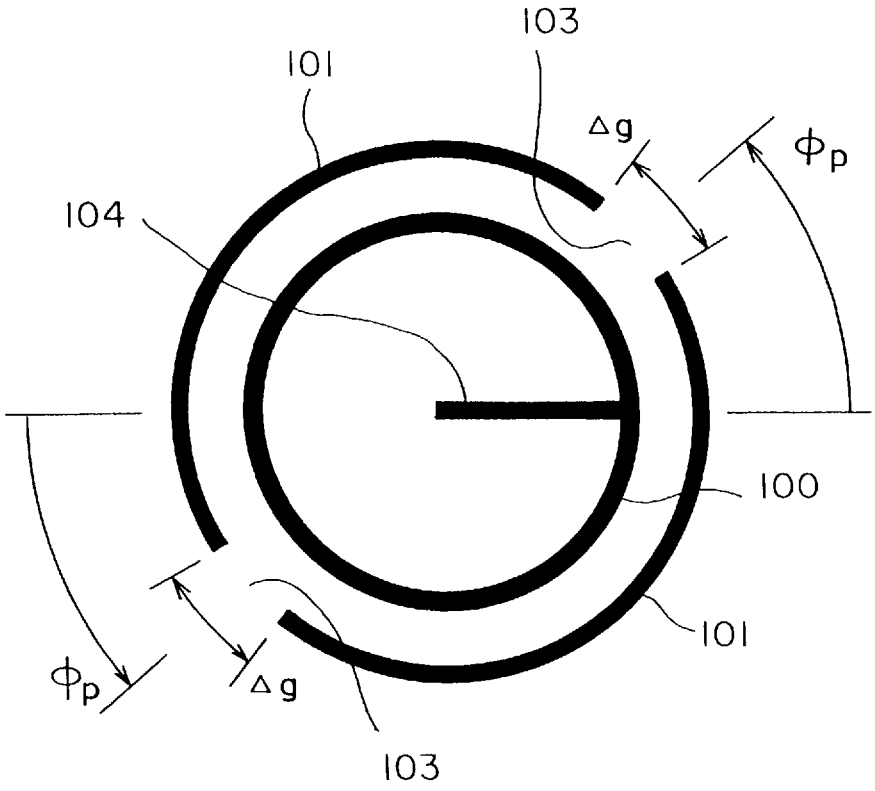
Fig. 7 PRIOR ART
FIG. 7 is a top view showing another example of a construction of the conventional loop antenna for circularly polarized wave.

Next, assuming that the frequency is 11.85 [GHz], the natural space wavelength is λ, and c=1.31λ, h=0.15λ, $\Phi_a$=320°, l=0.208λ, Δg=0.018λ are 0 or −23°, given, the gain vs. frequency characteristics and the circularly polarized wave axial ratio vs. frequency characteristics will be shown in FIG. 3, and FIG. 4, respectively.

The gain characteristics of the loop antenna for a circularly polarized wave according to the present invention is shown as a in FIG. 3, indicating a high gain of about 8.6[dBi] over a broad frequency range of 8%. The axial ratio characteristics of the loop antenna for a circularly polarized wave according to the present invention is shown as a in FIG. 4, indicating a broad frequency range of about 6.1% wherein the circularly polarized wave axial ratio of 3.0 dB or less is attained.

Thus, the circularly polarized loop antenna according to the present invention can broaden the frequency range in which a circularly polarized wave axial ratio of 3.0 dB or less is attained by about five times compared to the conventional antenna, and can make the gain high over a wide frequency range as shown in FIG. 3; and therefore, one piece of the loop antenna for a circularly polarized wave according to the present invention can replace antennas in a communication system which transmit a plurality of circularly polarized wave modes with different frequencies in a frequency range higher than the L-band.

Particularly, since the loop antenna for a circularly polarized wave according to the present invention can be made small and low, it is suitable for being applied as a GPS or BS antenna mounted on mobile facilities.

The space h between the ground plane 3 and the C-type loop element 1 can be set in the range of about 0.05λ to 0.26λ, the angle $\Phi_a$ formed by the axis of the I-shape conductor 2 and the cutoff part 6 can be set in the range of about 315°~325°, the length Δg of the cutoff part 6 can be set in the range of about 0.01λ~0.02λ, the length 1 of the I-shape conductor can be set in the range of about 0λ~0.47λ, and the circumferential length c of the C-type loop element 1 can be set in the range of about 1.0λ~1.5λ.

In the foregoing description, the angle $\Phi_a$ was specified in the range of about 315°~325°; however, forming the cutoff part 6 at the position opposite to the above angle, about 135°~145°, will also produce a loop antenna for a circularly polarized wave having the characteristics described above. And in order to make a loop antenna for a circularly polarized wave of an inversely rotating mode, the angle $\Phi_a$ formed by the cutoff part 6 provided on the C-type loop element 1 and the I-shape part 2 is only needed to be about 35°~45° (215°~225°). That is, in the loop antenna for a circularly polarized wave according to the present invention, the angle $\Phi_a$ is sufficient to be set to ±35°~+45°, or ±135°~+145°.

Since the loop antenna for a circularly polarized wave according to the present invention has a broad antenna input impedance vs. frequency characteristics which is at least 1.5 times wider than the conventional antenna, dimensional tolerances on a production line and tolerances on characteristic dispersions of materials in use can be set wider. Therefore, the production process can be simpler, leading to lowering the production cost.

Being fed through the coaxial line 4, the loop antenna for a circularly polarized wave according to the present invention as in FIG. 1 and FIG. 2 can reduce the feeding loss, and it can be hard to be influenced by the surrounding conditions of the coaxial line 4, thereby maintaining the intrinsic property of the loop antenna for a circularly polarized wave.

The loop antenna for a circularly polarized wave can be made such that the C-type loop element 1 is formed on a dielectric substrate by microstrip lines; however, it can also be made by replacing the dielectric material with a foamed material that hardly exerts a dielectric function.

Further, a plurality of small holes can be bored on a cylindrical cavity or a straight waveguide along the longitudinal direction and the feeder conductors of the loop antenna for circularly polarized wave according to the present invention can be inserted into each of the holes, whereby a plurality of loop antennas for circularly polarized waves can be fed. An array antenna can be formed by this construction, which produce a higher gain.

Furthermore, a high gain flat array antenna can be formed by providing multiples of the loop antenna for circularly polarized waves according to the present invention on a radial waveguide.

INDUSTRIAL APPLICABILITY

As described above, since the loop antenna for a circularly polarized wave according to the present invention can be made by only one loop element, the construction is simpler and the circularly polarized loop antenna can also be made small and low; and therefore, it will be suitable for a BS or GPS antenna mounted on mobile facilities.

Since the loop antenna for a circularly polarized wave can be fed through a coaxial feeder, the feeder loss can be reduced, which make it hard for the loop antenna to be influenced by conditions surrounding the feeder, thereby maintaining the intrinsic property of the loop antenna.

Further, since the loop antenna for a circularly polarized wave according to the present invention has broad frequency characteristics against the circularly polarized wave axial ratio and a broad gain vs. frequency characteristics having a high gain, it can be used as a shared antenna in a communication system which transmits a plurality of circularly polarized wave modes with different frequencies. Since it has a broad antenna input impedance vs. frequency characteristics, the production process can be simpler, thereby reducing the production cost.

I claim:

1. A loop antenna for radiating a circularly polarized wave comprising:

a ground plane;

a C-type loop element having a cutoff part; and an I-shape conductor having one end connected to the C-type loop element and another end served as a feeding point, said I-shape conductor extending in a radial direction of the C-type loop element, said C-type loop element being located in a plane that is parallel to said ground plane with a predetermined space being provided between said ground plane and the parallel plane in which said C-type loop antenna is located, the I-shaped conductor being at an angle to the cutoff part on the C-type loop element which angle is about ±35°~±45°° or about ±135°~±145°.

2. A loop antenna for circularly polarized wave according to claim 1, wherein the circumferential length of the C-type loop element is about 1.0λ~1.5λ, where λ is a natural space wavelength.

3. A loop antenna for circularly polarized wave according to claim 2, wherein said predetermined space between the C-type loop element and the ground plane is about 0.05λ~0.26λ, where λ is a natural space wavelength.

4. A loop antenna for circularly polarized wave according to claim 3, wherein the length of the I-shape conductor is about 0λ~0.47λ, where λ is a natural space wavelength.

5. A loop antenna for circularly polarized wave according to claim 2, wherein the length of the I-shape conductor is about 0λ~0.47λ, where λ is a natural space wavelength.

6. A loop antenna for radiating a circularly polarized wave according to claim 1, wherein said predetermined space between the C-type loop element and the ground plane is about 0.05λ~0.26λ, where λ is a natural space wavelength.

7. A loop antenna for radiating a circularly polarized wave according to claim 6, wherein the length of the I-shape conductor is about 0λ~0.47λ, where λ is a natural space wavelength.

8. A loop antenna for radiating a circularly polarized wave according to claim 1, wherein the length of the I-shape conductor is about 0λ~0.47λ, where λ is a natural space wavelength.

* * * * *